US006141818A

United States Patent [19]

Weihrauch

[11] Patent Number: 6,141,818

[45] Date of Patent: Nov. 7, 2000

[54] BRUSH FOR GUM MASSAGE AND TOOTH CLEANING AND PROCESS FOR PRODUCING THE BRISTLES OF SUCH A BRUSH

[75] Inventor: Georg Weihrauch, Wald-Michelbach, Germany

[73] Assignee: Coronet_Werke GmbH, Wald Michelbach, Germany

[21] Appl. No.: 09/171,004

[22] PCT Filed: Apr. 12, 1997

[86] PCT No.: PCT/EP97/01839

§ 371 Date: Oct. 9, 1998

§ 102(e) Date: Oct. 9, 1998

[87] PCT Pub. No.: WO97/38603

PCT Pub. Date: Oct. 23, 1997

[30] Foreign Application Priority Data

Apr. 17, 1996 [EP] European Pat. Off. ..... 196 15 098

[51] Int. Cl.[7] ..... A46B 9/04

[52] U.S. Cl. ..... 15/167.1; 15/207.2; 300/21

[58] Field of Search ..... 15/167.1, 207.2, 15/DIG. 6; 300/21; D4/104, 111

[56] References Cited

U.S. PATENT DOCUMENTS

| | | | |
|---|---|---|---|
| 2,317,485 | 4/1943 | Rider . | |
| 2,634,167 | 4/1953 | Bible | 300/21 |
| 2,845,648 | 8/1958 | Peterson | 15/207.2 |
| 3,118,527 | 1/1964 | Lombardy et al. . | |
| 3,425,206 | 2/1969 | Holton . | |
| 3,505,163 | 4/1970 | Meers . | |
| 3,840,932 | 10/1974 | Balamuth et al. | 15/167.1 |
| 4,524,480 | 6/1985 | Bloom | 15/207.2 |
| 5,195,546 | 3/1993 | Cansler . | |
| 5,881,426 | 3/1999 | Tong | 15/167.1 |

FOREIGN PATENT DOCUMENTS

| | | | |
|---|---|---|---|
| 01 30611 | 5/1989 | European Pat. Off. . | |
| 26 63 826 | 1/1992 | France . | |
| 26 87 055 | 8/1993 | France . | |
| 2 21 481 | 4/1985 | German Dem. Rep. . | |
| 14 35 478 | 2/1964 | Germany . | |
| 30 35 860 | 4/1981 | Germany . | |
| 31 16 189 | 12/1982 | Germany . | |
| 32 05 641 | 9/1983 | Germany . | |
| 35 14 600 | 8/1986 | Germany . | |
| 87 04 237 | 1/1988 | Germany . | |
| 38 33 428 | 2/1990 | Germany . | |
| 91 05 147 | 6/1992 | Germany . | |
| 43 14 692 | 11/1994 | Germany . | |
| 295 01 338 | 6/1995 | Germany . | |
| 44 17 548 | 11/1995 | Germany . | |
| 6-70813 | 3/1994 | Japan | 15/207.2 |

*Primary Examiner*—Terrence R. Till
*Attorney, Agent, or Firm*—Paul Vincent

[57] ABSTRACT

A gingival massaging and tooth cleaning brush comprises a bristle carrier with handle and on the bristle carrier individual or bundlewise fixed plastic bristles. For improving the massaging action the bristles are waved transversely to their axis, accompanied by the formation of distinct, stud-like wave tops and with a short wave length.

14 Claims, 3 Drawing Sheets

BRUSH FOR GUM MASSAGE AND TOOTH CLEANING AND PROCESS FOR PRODUCING THE BRISTLES OF SUCH A BRUSH

BACKGROUND OF THE INVENTION

The invention relates to a brush for gingival massage and cleaning teeth, comprising a bristle carrier with a handle and on the bristle carrier individual or bundlewise fixed plastic bristles.

Nowadays oral hygiene not only consists of cleaning the teeth, but also gingival massage to prevent gingivitis, periodontitis, etc. Conventional toothbrushes, no matter whether they are operated manually or electrically, admittedly adequately fulfil the tooth cleaning function, but not the gingival massaging function, particularly if both effects are to be obtained on the same movement path. Thus, for cleaning teeth, particularly for cleaning interdental spaces, the bristle ends are particularly effective, but are frequently too aggressive for gingival massage, particularly if they are not perfectly rounded or have already become flattened due to use. However, for gingival massage the pressure and movement path must be chosen in such a way that the bristles bend round and give a type of stroking massage with their circumferential surface. However, in this position they are far less effective for tooth cleaning and are unfit for interdental space cleaning.

Therefore an effective gingival massage is only possible with special instruments, whose working surface is generally of rubber-like materials and having a burl-like profiling (GB 398 919, U.S. Pat. No. 1,892,068). These instruments are in turn completely unsuitable for cleaning teeth. Thus, for a complete oral hygiene two operations are necessary and possibly even two different instruments must be used. This is tiresome and consequently gingival massaging instruments have not acquired practical significance.

In addition, toothbrushes are known, whose bristle facing is adapted to the different aims when cleaning the teeth and massaging the gingiva. Such a toothbrush has a comparatively hard, central facing and more flexible massaging bristles in the outer area. This necessarily constitutes a compromise, the allocation of the different bristle areas to their associated treatment spheres, i.e. tooth or gingiva, is not readily possible on the part of the user. In addition, this compromise always benefits one action to the detriment of the other.

A conventional tooth brush follows this principle (DE-U-295 01 338) with which pile threads are mounted to the bristle carrier in addition to the usual linear bristles. Pile threads are loose textile fibers which are curled by thermal shrinkage. These pile threads cannot effect cleaning as can bristles.

SUMMARY OF THE INVENTION

The problem of the invention is to propose a gingival massaging brush, which equally effectively can be used for cleaning the teeth.

According to the invention this problem is solved in that the bristles are waved transversely to their axis accompanied by the formation of distinct, bud-like wave tops with a short wave length.

The bristle constructed according to the invention has, like any conventional bristle, a rounded working end, which acts both for cleaning the teeth and for gingival massage, in the latter case as a type of massaging finger. Moreover, with the unavoidable bending round of the bristle the stud-like wave tops act in a similar manner to the bristle ends namely both during cleaning the teeth and when massaging the gingiva. With a corresponding pressure of the bristle facing, in which the bristles bend round, for each individual, engaging bristle at the same time several wave tops act in a cleaning and/or massaging manner. Thus, in a single operation with a single instrument, it is possible to carry out the measures necessary for a completely satisfactory oral hygiene.

Due to the waving or corrugation of the bristles, labyrinth-like channels are formed between the individual bristles, where an excellent storage can take place of dentifrice products. This in particular applies for the now frequently used gels, which can be pressed during application into the interdental gaps. In the case of toothbrushes with a conventional bristle facing, due to their limited viscosity, such gels frequently drip off and lead to corresponding losses. However, such a brush can be easily washed and the bristles and bristle gaps dry rapidly, so that there can be no embedding of dirt and bacteria.

In a preferred development, the bristles are waved in two or more planes, which ensures that, independently of how the bristle bends round during brushing, bud-like wave tops always come into action.

Whereas in the case of a conventional circular cross-section of a bristle, the wave tops are rounded to a greater or lesser extent, with a cross-section diverging from the circular shape on the one hand preferred bending planes can be produced and on the other the wave tops are much more distinct. Thus, the bristles can e.g. have an oval cross-section, but preferably a polygonal cross-section with rounded longitudinal edges. In particular a cross-section shaped as a cross is a suitable polygonal cross-section.

The action of the bristles constructed according to the invention can also be influenced by the geometry of the individual waves. For example, the wave length can be 1 to 10 times the bristle diameter, but is more advantageously between 1 and 5 times. In a preferred embodiment the wave length is smaller than twice the bristle diameter.

Moreover, the wave height, i.e. the spacing between adjacent wave tops, should be as small as possible and is preferably 1.2 to twice the bristle diameter.

Significance is also attached to the wave top shape and angular, distinct wave tops are preferred to rounded tops.

It is admittedly known in connection with wire brushes to wave or corrugate the wire pins used, but the main aspect applicable here is stability and abrasive action (U.S. Pat. No. 1,178,179, DE-U-79 06 716). In addition, hairpin brushes are known (U.S. Pat. No. 2,511,004), which are made from plastic, but whose shape is as close as possible to the natural bristle. These bristles have a long wave profiling and are pointed at their ends and are mainly intended for brushes for artists and painters. The manufacture of such bristles takes place in that, starting from a continuous monofilament, the latter is constricted at uniform intervals by tensile forces. The bristles are then cut in each case in the vicinity of the constriction, so that an individual bristle with two pointed ends is formed. The said individual bristle is subsequently passed through spaced shaping roller pairs at right angles to one another. In order to prevent an axial twisting of the bristle under the action of the shaping forces, shaping is to take place accompanied by the simultaneous application of heat. This is absolutely unacceptable with bristles, because when bristles are formed from continuous monofilaments the monofilaments are stretched and possibly also thermally stabilized in order to orient the macromolecules and consequently give the bristle the necessary flexibility and adequate stiffness. These properties are lost during a subsequent heat treatment due to reorientation.

Known in the art of manufacture of loose textile fibers (U.S. Pat. No. 3,424,206) is the pulling of a multi-filament, portions of which are curled, using toothed shaping rollers in order to crimp the yarn. Neither the precision with which the crimping is effected nor the position relative to the yarn axis are important.

The problem of the invention is therefore to propose a method for the manufacture of bristles constructed according to the invention avoiding the aforementioned disadvantages.

Thus, the method according to the invention is characterized in that the plastic continuous monofilament is passed through the shaping rollers and wound behind the latter onto a reel, the monofilament being held in twisting-prevented manner with respect to its axis and that the bristles are produced by cutting the waved continuous monofilament to length.

Preferably the continuous monofilament is drawn by means of the shaping rollers from a reel. However, instead of this it is also possible to supply the continuous monofilament, following its production in an extruder, to the shaping rollers. The waving takes place without any additional heat supply from the outside.

Preferably the monofilament is passed between at least two directly succeeding shaping roller pairs, which have the minimum spacing, in order to irreversibly shape in the distinct wave tops.

If the monofilament is passed between two shaping roller pairs with pairwise angularly positioned axes or spindles, then a waving in two planes can be obtained. In the same way, by means of three shaping roller pairs with pairwise angularly positioned axes or spindles, a waving in three planes is possible.

Instead of this, simultaneously several plastic continuous monofilaments can be guided in spaced juxtaposed manner and drawn by means of the shaping rollers from a reel and behind the latter are wound onto a reel, here again the individual monofilament being held in twisting-prevented manner with respect to its axis or spindle.

In a preferred development, the continuous monofilament is passed between shaping roller pairs of 10 to 20 mm, whose axial spacing is roughly the same.

The invention is described in greater detail hereinafter relative to non-limitative embodiments and the attached drawings, wherein show:

DESCRIPTION OF THE PREFERRED EMBODIMENT

Figure 1:
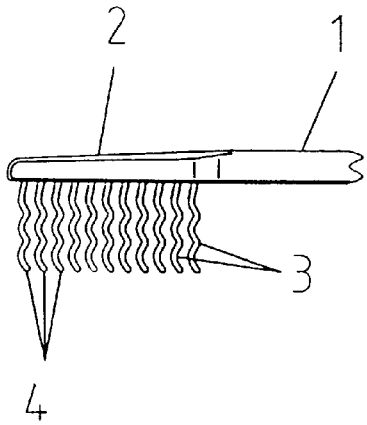
FIG. 1 A broken away side view of a gingival massaging and tooth cleaning brush.

FIG. 1 shows a gingival massage and tooth cleaning brush comprising a handle 1, a head 2 serving as the bristle carrier and a plurality of individual bristles 3. The bristles 3 can optionally be combined into bundles or packs. All or part of the bristles are waved with a short wave length. As in the embodiment shown, the use-side ends 4, following the wave shape, can be bent out of the bristle axis.

Figure 2:
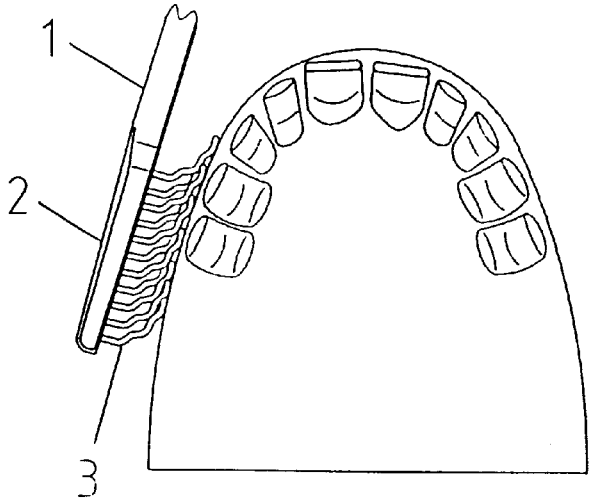
FIG. 2 A diagrammatic view of the operation of the brush on the teeth.

It is clear that the bud-like wave tops form active edges during gingival massage, as is indicated in FIG. 2. Thus, during gingival massage preferably the pressure exerted is such that the bristles are deflected out of their stretched position and the wave tops come into action. However, when cleaning the teeth, working takes place with the same or a reduced pressure, so that the bristles become upright and the use-side ends 4 come into action. As a result of the curvature at the use-side ends, in particular the interdental gaps are effectively cleaned.

Figure 3:
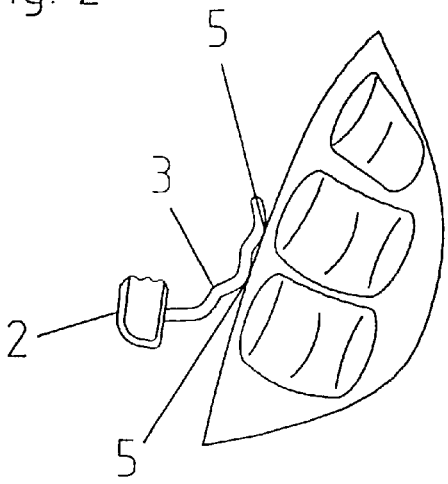
FIG. 3 A larger-scale partial view of a bristle of the brush during gingival massage.

FIG. 3 shows on a larger scale a bristle 3 when the brush is in use. It is clear how the bud-like wave tops act in the manner of massaging burls on the gingiva.

Figure 4:
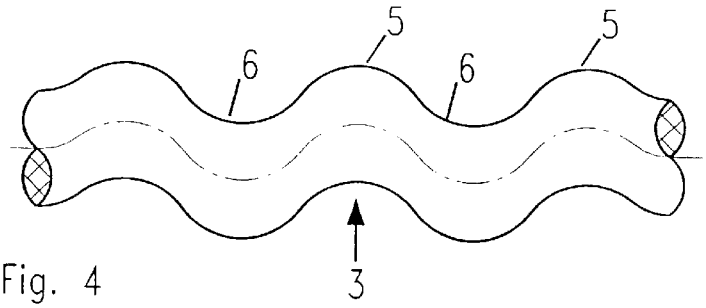
FIG. 4 A longitudinal portion of a waved bristle.
Figure 5:
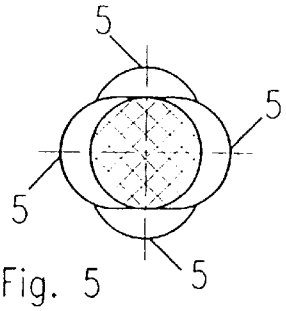
FIG. 5 A cross-section through the bristle of FIG. 4.

FIG. 4 is a larger scale partial view of a bristle 3, which is uniformly sinusoidally waved, so that bud-like wave tops 5 and wave troughs 6 are formed. Whereas the wave tops 5 form the active working surfaces of the bristle, the wave troughs 6 receive dentifrice and the like. The bristle according to FIG. 4 can have a cross-section according to FIG. 5, i.e. can be waved in two planes perpendicular to one another, so that on the bristle envelope bud-like wave tops 5 extend in the direction of all four coordinates.

Figure 6:
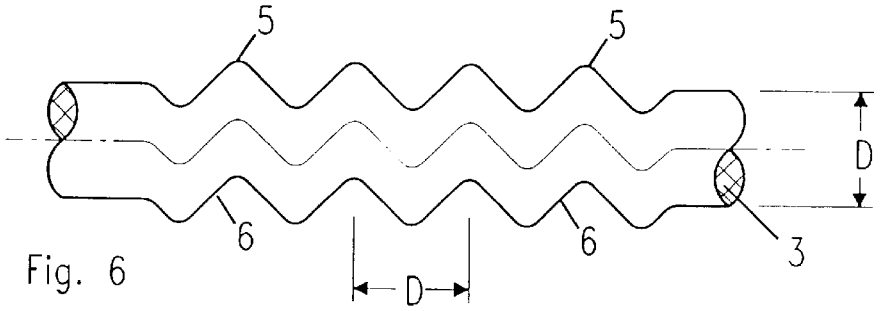
FIG. 6 A longitudinal portion of a bristle with another wave shape.

FIG. 6 shows a bristle with a modified wave shape. The wave flanks are substantially linear and the bud-like wave tops 5 have a much smaller radius of curvature. In this embodiment the wave length roughly corresponds to the bristle diameter, as indicated by the letter D.

Figure 7:
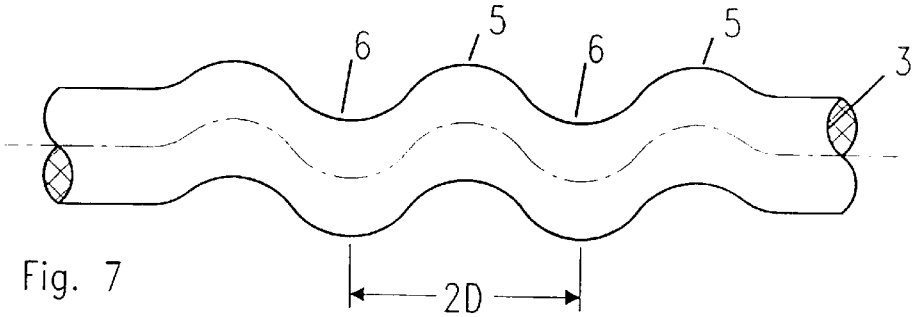
FIG. 7 A longitudinal portion of a bristle with a wave shape similar to FIG. 4.
Figure 8:
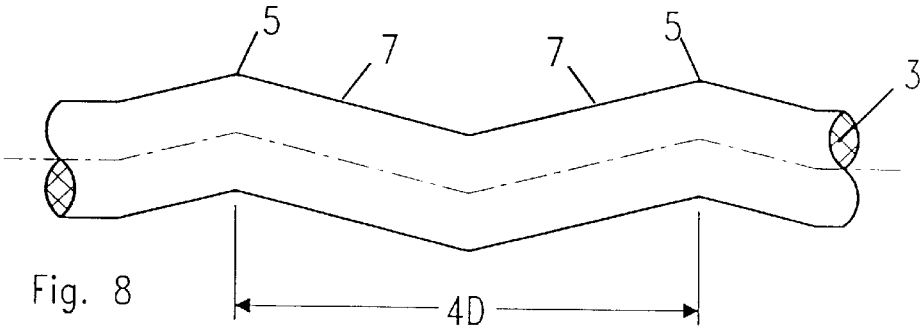
FIG. 8 A longitudinal portion of a bristle with another modified wave shape.
Figure 9:
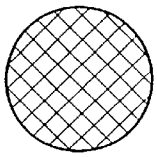
FIG. 9 a first cross sectional shape of the bristle.
Figure 10:
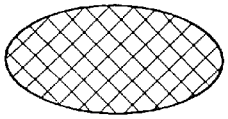
FIG. 10 a second cross sectional shape of the bristle.
Figure 11:
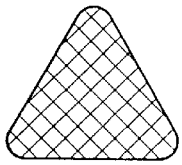
FIG. 11 a third cross sectional shape of the bristle.
Figure 12:
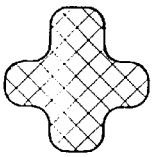
FIG. 12 a fourth cross sectional shape of the bristle.

FIG. 7 shows a bristle similar to FIG. 4 with a wave length which is roughly twice the bristle diameter. FIG. 8 shows a bristle with a relatively elongated wave and linear flanks 7 and even more marked wave tops 5 with a small radius of curvature. The wave length in this bristle is approximately four times the bristle diameter.

Figure 13:
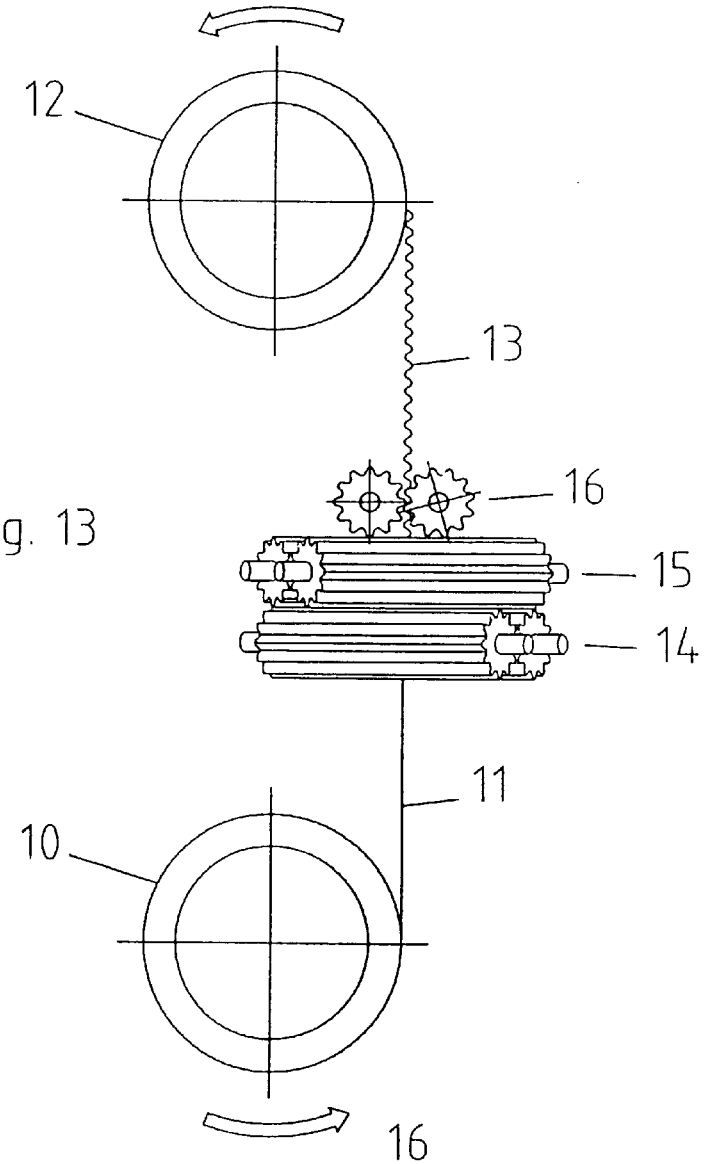
FIG. 13 A diagrammatic side view of an apparatus for producing the waved bristle.
Figure 14:
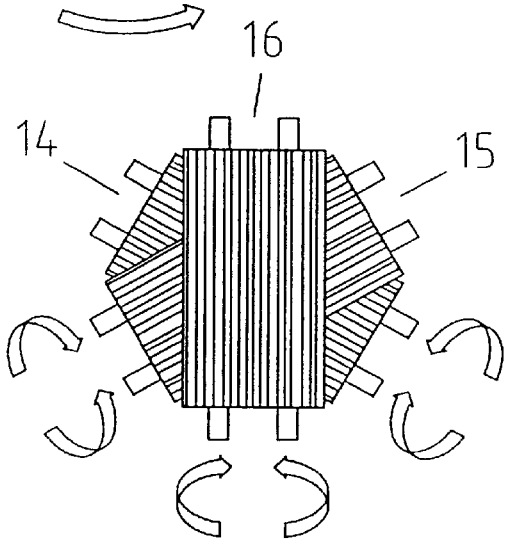
FIG. 14 A plan view of the shaping rollers of the apparatus of FIG. 13.

FIGS. 13 and 14 show an apparatus for performing the method according to the invention. It has a supply reel 10 on which is wound a plastic continuous monofilament 11. It also has a collecting reel 12 for receiving the waved monofilament 13. The monofilament 11 passes through three successively positioned shaping roller pairs 14, 15 and 16, whose circumference is profiled in accordance with the desired wave shape (FIGS. 4 to 8). The spindles of the shaping roller pairs 14, 15 and 16, whereof the spindles of at least one pair are driven, are arranged in immediately succeeding manner, so that they just fail to come into contact. As shown in FIG. 14, they are also turned by in each case 60° relative to one another. The collecting reel 12 prevents the monifilament 11 from twisting about the bristle axis.

The shaping rollers preferably have a diameter of 10 to 20 mm and the mutual spacing of their spindles, as well as the other spindles of adjacent shaping roller pairs 14, 15 and 16 is only insignificantly larger, i.e. roughly by the monofilament diameter. This leads to a waved monofilament 13, whose wave tops are in three different axial planes of the bristle.

What is claimed is:

1. A brush for gingival massage and cleaning teeth, the brush comprising:

a bristle carrier having a handle; and plastic bristles fixed to said bristle carrier, said bristles having a waved shape transverse to a bristle axis to form protruding bud-shaped wave tops, wherein said waved shape has a wave height between 1.2 and 2 times a bristle diameter.

2. The brush of claim 1, wherein said bristles are waved in at least two planes.

3. The brush of claim 1, wherein said bristles have a non-circular cross section.

4. The brush of claim 3, wherein said cross section is oval.

5. The brush of claim 3, wherein said cross section is polygonal with rounded edges.

6. The brush of claim 1, wherein said waved shape has a wave length between 1 and 10 times a diameter of said bristles.

7. The brush of claim 6, wherein said wave length is between 1 and 5 times said diameter.

8. The brush of claim 7, wherein said wave length is less than two times said diameter.

9. The brush of claim 1, wherein said wave tops are distinctly angled.

10. A method for manufacturing plastic bristles for use in a brush, the bristles fixed to a bristle carrier and having a waved shape transverse to a bristle axis to form protruding bud-shaped wave tops, the method comprising the steps of:

a) passing a plastic continuous monofilament member between a first pair of two gear-like shaping rollers to wave said monofilament member;

a1) passing said monofilament member between a second pair of sharing rollers directly downstream of said first pair of rollers, wherein said second pair of rollers have second parallel axes forming an angle with respect to first parallel axes of said first pair of rollers;

a2) passing said monofilament member between a third pair of shaping rollers directly downstream of said second pair of rollers, said third pair of rollers having third parallel axes forming an angle with respect to said first and said second parallel axes;

b) holding said monofilament member during steps a), a1), and a2) to prevent twisting about the bristle axis;

c) winding said monofilament member downstream of said first pair of rollers onto a take-up reel; and d) cutting said monofilament member to length for producing the bristles.

11. The method of claim 10, further comprising the step of drawing said monofilament member from a supply reel using said first pair of rollers.

12. The method of claim 10, further comprising the step of producing said monofilament member in an extruder prior to step a).

13. The method of claim 10, wherein said monofilament member comprises a plurality of individual monofilaments guided at mutual separation from each other through said first pair of rollers and further comprising the step of extracting said plurality of individual monofilaments from a supply reel.

14. The method of claim 10, wherein said first pair of rollers comprises a first roller member and a second roller member each having a diameter between 10 and 20 mm, said first roller member having an axis separated from an axis of said second roller member by an amount exceeding said first and said second roller member diameter by a diameter of said monofilament member.

* * * * *